US012234054B2

(12) United States Patent
Reinhart

(10) Patent No.: US 12,234,054 B2
(45) Date of Patent: Feb. 25, 2025

(54) SHIPPING TRAY FOR CHAIR SYSTEM AND METHOD

(71) Applicant: NICKOLAS BRANDS, LLC, Findlay, OH (US)

(72) Inventor: Nickolas Reinhart, Sarasota, FL (US)

(73) Assignee: Findlay Machine & Tool, LLC, Findlay, OH (US)

( * ) Notice: Subject to any disclaimer, the term of this patent is extended or adjusted under 35 U.S.C. 154(b) by 88 days.

(21) Appl. No.: 18/170,758

(22) Filed: Feb. 17, 2023

(65) Prior Publication Data

US 2023/0264857 A1 Aug. 24, 2023

Related U.S. Application Data

(60) Provisional application No. 63/311,664, filed on Feb. 18, 2022.

(51) Int. Cl.
*B65D 19/00* (2006.01)
*B65D 85/64* (2006.01)

(52) U.S. Cl.
CPC ..... *B65D 19/0002* (2013.01); *B65D 85/64* (2013.01); *B65D 2519/00069* (2013.01); *B65D 2519/00268* (2013.01); *B65D 2519/00402* (2013.01); *B65D 2519/008* (2013.01); *B65D 2585/648* (2013.01)

(58) Field of Classification Search
CPC .... B65D 19/0002; B65D 19/00; B65D 19/44; B65D 85/64; B65D 2519/00069; B65D 2519/00268; B65D 2519/00402; B65D 2519/008; B65D 2585/648; B65D 25/04; B65D 77/0433; B65D 1/34
USPC ..... 108/57.28, 53.3, 55.3, 901; 297/239; 211/194
See application file for complete search history.

(56) References Cited

U.S. PATENT DOCUMENTS 3,490,602 A * 1/1970 Wentzel ..... B65D 1/34 D7/553.3
3,702,100 A * 11/1972 Wharton ..... B65D 19/0038 108/901
5,857,416 A * 1/1999 Donnell, Jr. ..... B65D 19/004 108/55.3
D459,050 S * 6/2002 Meyer ..... D34/38
7,779,764 B2 * 8/2010 Naidu ..... B65D 19/0095 108/56.1
8,555,787 B2 10/2013 Haaf
9,149,122 B1 * 10/2015 Jannetides ..... B65D 85/62
9,440,770 B2 9/2016 Mueller
(Continued)

FOREIGN PATENT DOCUMENTS

DE 102008022366 A1 11/2009
DE 102009041436 A1 3/2011
(Continued)

*Primary Examiner* — Janet M Wilkens
(74) *Attorney, Agent, or Firm* — Jacob M. Ward; Ward Law Office LLC

(57) ABSTRACT

Embodiments of the present disclosure may include a shipping tray for a chair having a plurality of legs including a top side, bottom side, front support, rear support, first side support, second side support, a central brace, a plurality of holders, and a plurality of structural ribs. Embodiments may also include a shipping tray system, and a method of stacking a chair having a plurality of legs on the shipping tray.

13 Claims, 6 Drawing Sheets

(56) References Cited

U.S. PATENT DOCUMENTS

| | | | | |
|---|---|---|---|---|
| 10,399,739 | B2 | 9/2019 | Lenz et al. | |
| 10,604,298 | B2 | 3/2020 | Ramon et al. | |
| 10,737,834 | B2 | 8/2020 | Veldhuis et al. | |
| 10,850,889 | B2 | 12/2020 | Ramon et al. | |
| D925,158 | S | 7/2021 | Ramon et al. | |
| D925,859 | S | 7/2021 | Ramon et al. | |
| D1,010,447 | S * | 1/2024 | Reinhart | D9/456 |
| D1,033,227 | S * | 7/2024 | Reinhart | D9/456 |
| 2006/0032411 | A1* | 2/2006 | Hummel | B65D 19/0097 108/56.1 |
| 2012/0037050 | A1* | 2/2012 | Nevo | B65D 19/0038 108/51.11 |
| 2012/0291678 | A1* | 11/2012 | Howland | B65D 19/0018 108/51.11 |
| 2023/0348135 | A1* | 11/2023 | Reinhart | B65D 19/00 |

FOREIGN PATENT DOCUMENTS

| | | | | |
|---|---|---|---|---|
| DE | 102012221279 | A1 | 5/2014 | |
| EP | 514237 | A1 * | 11/1992 | B65D 19/0095 |
| EP | 524868 | A1 * | 1/1993 | B65D 19/44 |
| EP | 1155965 | A1 * | 11/2001 | B65D 19/004 |
| EP | 3135596 | A1 | 3/2017 | |
| WO | WO-2010095129 | A1 * | 8/2010 | B65D 19/0038 |
| WO | 2011107429 | A1 | 9/2011 | |
| WO | WO-2014146160 | A1 * | 9/2014 | B29C 65/70 |

* cited by examiner

SHIPPING TRAY FOR CHAIR SYSTEM AND METHOD

CROSS-REFERENCE TO RELATED APPLICATIONS

This application claims the benefit of U.S. Provisional Application No. 63/311,664, filed on Feb. 18, 2022. The entire disclosure of the above application is incorporated herein by reference.

FIELD

The present technology includes processes and articles of manufacture that relate to shipping trays, including a shipping tray for a chair system and method.

INTRODUCTION

Shipping trays can be used to transport a variety of goods as they are moved from producer to seller and during storage. Such shipping trays can be used to support these same goods when they are moved by a device such as a forklift and a pallet jack.

A shipping tray holding goods is easy to move and is stable when carrying a large load. Shipping trays also allow goods to be unloaded quickly and easily from a transport truck. This can enable a producer and a supplier to save on transportation and handling costs. Additionally, shipping trays can provide a stable base to prevent goods from tipping over and being damaged during shipping and storage. To be properly utilized however, a shipping tray should be able to properly support and hold the goods during transport and storage. Particularly, a shipping tray should be properly reinforced and structurally stable so that it does not bend and cause a tip over or even a breakage of the shipping tray and damage to the goods.

Accordingly, there is a need for a shipping tray that is structurally reinforced and structurally stable so that it can hold heavy material during shipping and storage.

SUMMARY

In concordance with the instant disclosure, a shipping tray that is structurally reinforced and structurally stable so that it can hold heavy material during shipping and storage, is surprisingly discovered.

Embodiments of the present disclosure may include a shipping tray for a chair having a plurality of legs. The shipping tray may have a top side and a bottom side. Further the shipping tray may have a front support including a first front corner and a second front corner, and a rear support including a first rear corner and a second rear corner. The shipping tray may also have a first side support, a second side support, and a central brace that connects the first front corner, the second front corner, the first rear corner, and the second rear corner together. There may be a plurality of holders disposed at the first front corner, the second front corner, the first rear corner, and the second rear corner as well. The bottom side of the front support, rear support, first side support, second side support, and central brace may be hollow and there may be a plurality of structural ribs disposed within.

Some embodiments include a shipping tray system that comprises a shipping tray for a chair, having a plurality of legs, and a first chair having a plurality of legs. The shipping tray may include a top side, bottom side, front support, rear support, first side support, second side support, a central brace, and a plurality of holders. The plurality of legs of the first chair may be received in the plurality of holders of the shipping tray. In some embodiments, the first chair may comprise a plurality of chairs stacked on top of the first chair, where the plurality of chairs includes at least one chair stacked on top of another chair.

Another embodiment includes a method of stacking a chair having a plurality of legs on a shipping tray, providing a first chair having a plurality of legs, and a shipping tray for the chair having the plurality of legs. The shipping tray may include a top side, bottom side, front support, rear support, first side support, second side support, a central brace, and a plurality of holders. The method may include the step of disposing the first chair on the shipping tray so that the plurality of holders of the shipping tray receive the plurality of legs of the first chair. In some embodiments, the first chair may comprise a plurality of chairs stacked on top of the first chair, where the plurality of chairs includes stacking at least one of a second chair on top of the first chair.

In some examples, the shipping tray includes a body including a front support, a rear support, two side supports, and four corners, a plurality of recesses where a recess is located at each one of the four corners of the body, and an x-patterned brace including a first leg for connecting a first rear corner and a first front corner of the body and a second leg connecting a second rear corner and a second front corner of the body, the first leg and the second leg disposed at a transverse angle.

In further examples, the shipping tray comprises a body including a front support, a rear support, two side supports, and four corners. Each corner includes a recess configured to accept a leg of a chair. The shipping tray also includes an X-patterned brace including a first leg for connecting a first rear corner and a first front corner of the body and a second leg connecting a second rear corner and a second front corner of the body.

In another example, the front support is 27 inches in length and the rear support is 23 inches in length. However, the front support and the rear support can comprise any appropriately desired length. For example, in some embodiments the rear support is 27 inches in length and the front support is 27 inches in length. The shipping tray comprises two side supports that can include one or more oblong-shaped apertures. For example, such as shown within FIGS. 1 and 2, the side supports comprise four oblong-shaped apertures. However, the side supports can comprise any appropriately desired number and shape of apertures.

In additional examples, the center of the shipping tray includes an X-pattern brace the connects and supports each recess. The first leg and the second leg of the X-pattern brace are disposed at a transverse angle. Particularly, as shown within FIGS. 1 and 2, the first leg and the second leg are not disposed at a 90-degree right angle. In some embodiments, the first leg has a long section and a short section, relative to each other, and the second leg has a long section and a short section, relative to each other. In some embodiments, each recess includes one or more elbows at an outside of the recess which further strengthens the recesses as they support an object during storage in transport.

In some examples, the shipping tray is configured to transport one or more Adirondack chairs. Each corner of the shipping tray includes a recess configured to accept a leg of a chair. However, as will be apparent to someone of ordinary skill in the art, the shipping tray can be configured to transport any desired chair comprising four legs.

In some embodiments, the shipping tray further includes structural ribbing on an underside of the supports and the X-patterned brace. The structural ribbing can be located in those areas where it is desirable to add structural stability to the shipping tray. For example, in some embodiments the side supports comprise side support structural ribbing along a bottom length of the side supports and also cross ribbing across the side support structural ribbing. Similarly, the front support and the rear support can include cross wise structural ribbing. As shown in FIG. 2, the X-patterned brace can comprise X-shaped structural ribbing. In some embodiments, each corner of the shipping tray includes corner structural ribbing. Particularly, the structural ribbing and the X-patterned brace can add stability and strength to the shipping tray while at the same time minimizing the weight of the shipping tray.

In another example the leg of the chair is placed into each recess of the shipping tray such that the shipping tray can support the chair. As described above, the shipping tray can include four recesses, which are each configured to receive and secure a leg of the chair.

In an additional example, there may be a method of manufacturing a shipping tray in accordance with the present technology. In step, a body including a front support, a rear support and four corners is formed and in step, a x-patterned brace including a first leg for connecting a first rear corner and a first front corner of the body and a second leg connecting a second rear corner and a second front corner of the body is formed. The first leg and the second leg may be disposed at a transverse angle. The shipping tray can be manufactured using injection molding of a plastic material.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
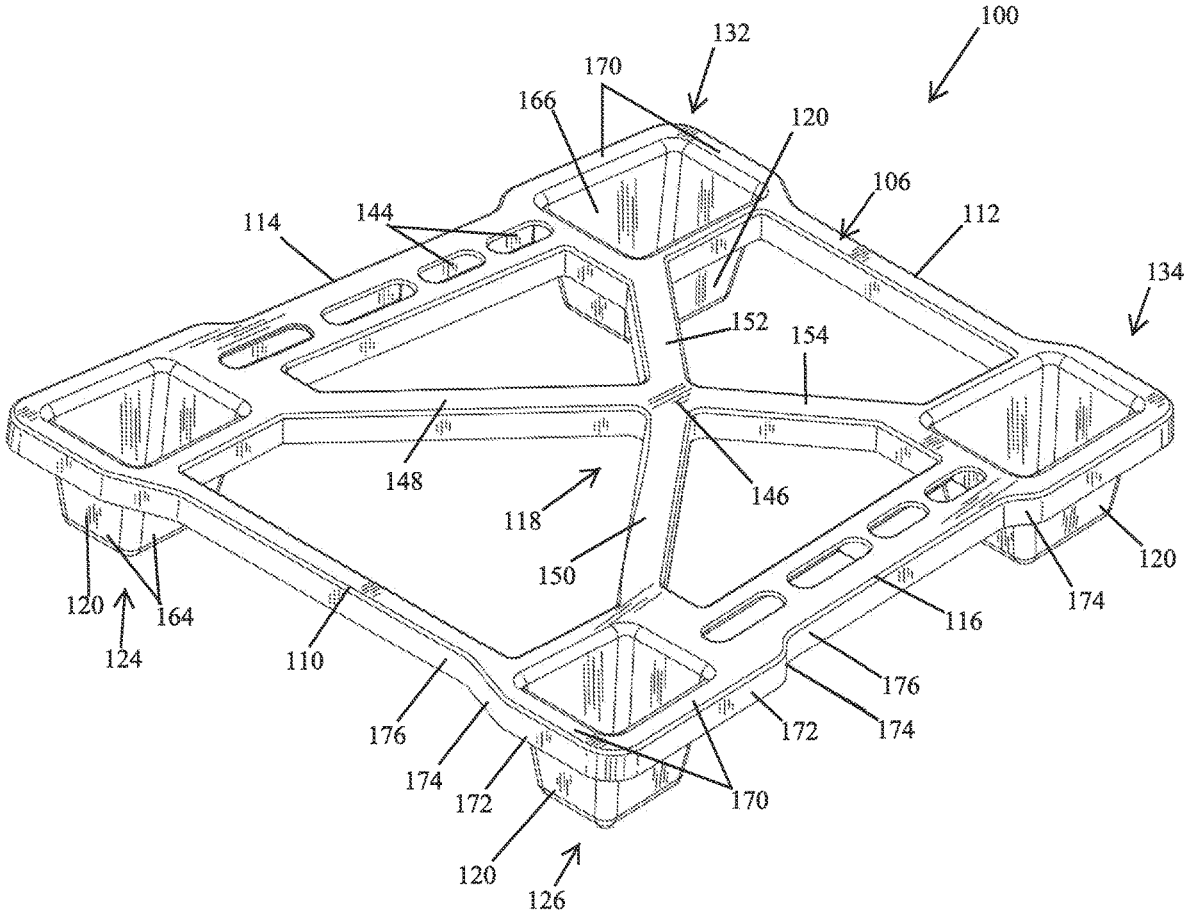
FIG. 1 is a front top perspective view of the shipping tray in the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9,1-8,1-3,1-2,2-10, 2-8,2-3,3-10,3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology improves on shipping trays for chairs and related systems and methods for stacking chairs for on shipping trays for transport and storage.

Figure 2:
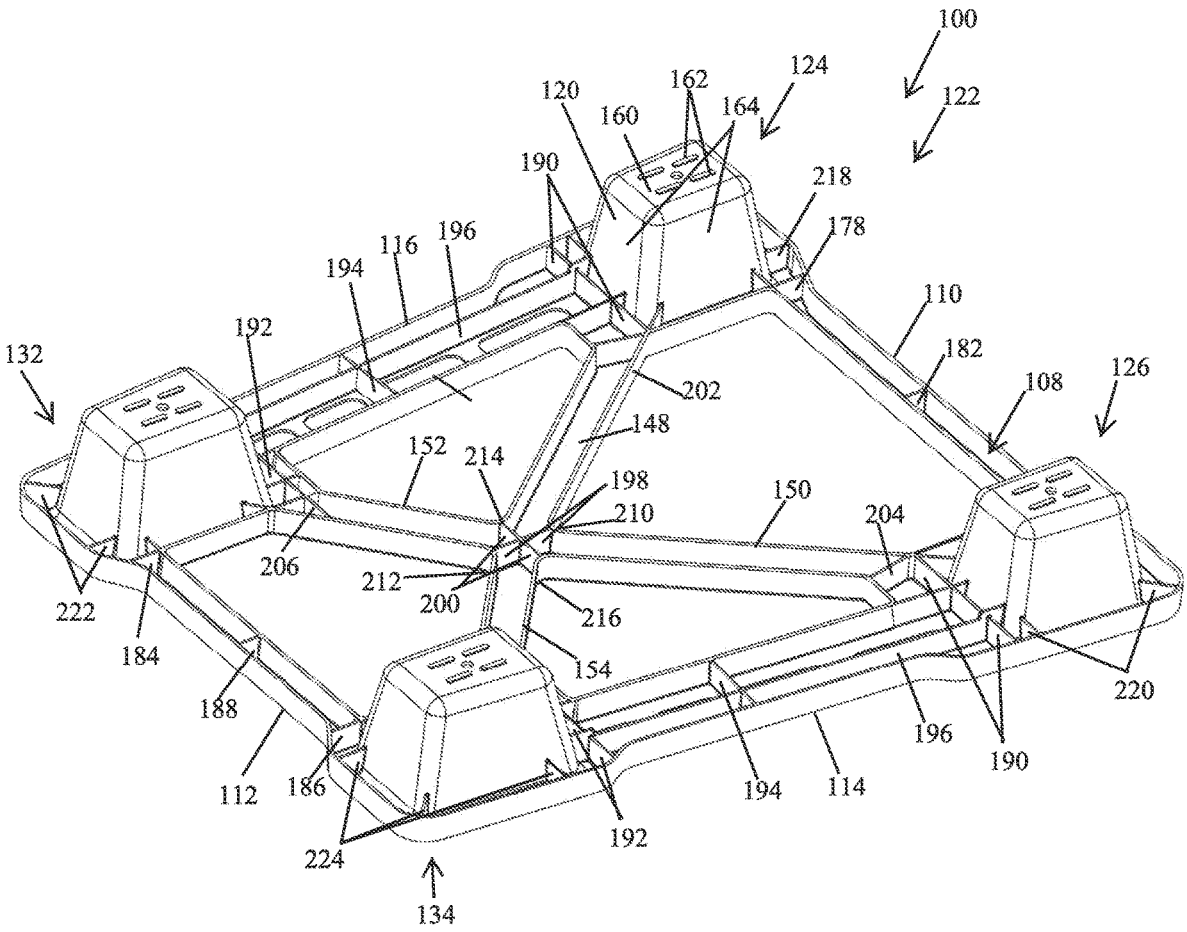
FIG. 2 is a rear bottom perspective view of the shipping tray in the present disclosure.
Figure 3:
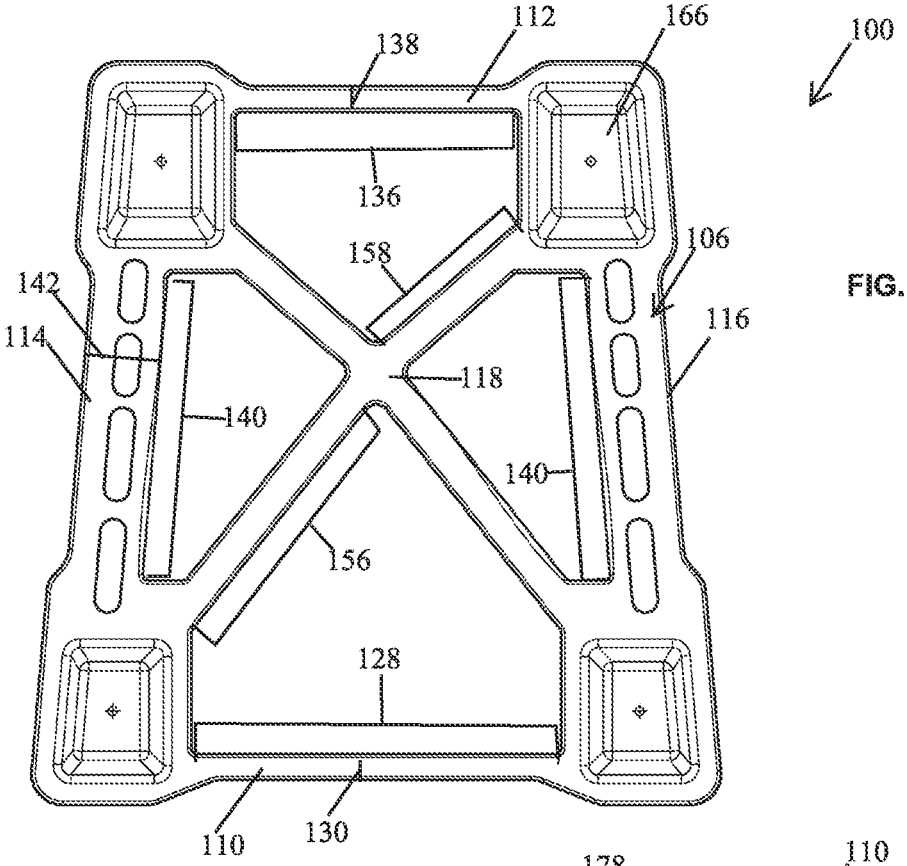
FIG. 3 is a top plan view of the shipping tray.
Figure 4:
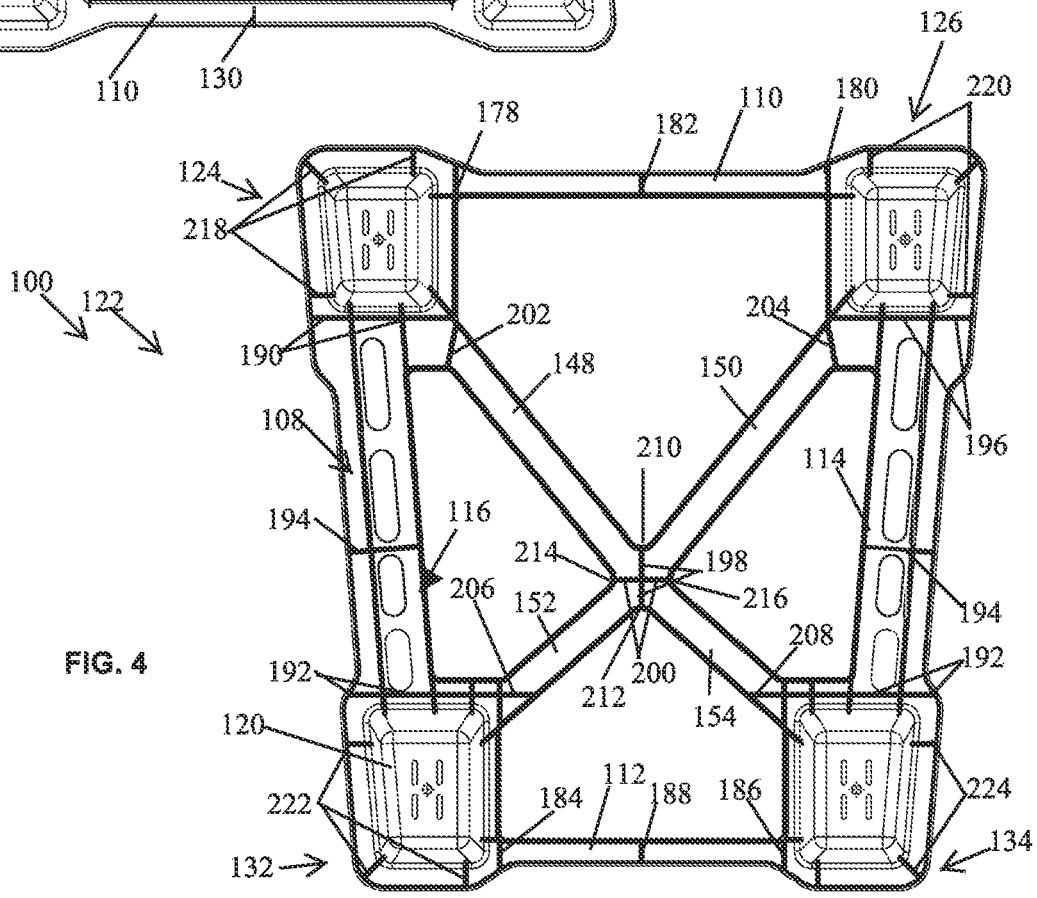
FIG. 4 is a bottom plan view of the shipping tray.

FIGS. 1-6 show a shipping tray 100 for holding a chair 102 with a plurality of legs 104. In some embodiments the shipping tray 100 has a top side 106, a bottom side 108, a front support 110, a rear support 112, a first side support 114, a second side support 116, and a central brace 118. There may be a plurality of holders 120 configured to receive the plurality of legs 104 of the chair 102. In certain embodiments, as shown in FIGS. 2-4, there may also be a plurality of structural ribs 122 disposed on the bottom side 108 of the shipping tray 100.

As shown in FIG. 1-4, the front support 110 may have a first front corner 124, a second front corner 126, a front support length 128, and a front support width 130. The rear support 112 may have a first rear corner 132, a second rear corner 134, a rear support length 136, and a rear support width 138. The first side support 114 may connect the first front corner 124 to the first rear corner 132, and the second side support 116 may connect the second front corner 126 to the second rear corner 134. The first side support 114 and the second side support 116 may have a side support length 140, and a side support width 142.

As shown in FIGS. 1-2, the first side support 114 and the second side support 116 may each have a plurality of apertures 144 formed within. The plurality of apertures 144 may be arranged along the side support length 140, and may be stadium shaped. Inclusion of the plurality of apertures 144 that are stadium shaped may reduce the amount of material required to produce the shipping tray 100, without compromising the structural integrity as much as it would be compromised if a shape removing more material, such as a rectangle, were used. One skilled in the art may choose any number or arrangement of the plurality of apertures 144 that is deemed appropriate for the shipping tray 100.

As shown in FIGS. 3-4, the front support length 128 of the front support 110 may be greater than the rear support length 136 of the rear support 112. Additionally, the side support width 142 of the first side support 114 and the second side support 116 may be greater than the front support width 130 of the front support 110 and the rear support width 138 of the rear support 112.

As shown in FIGS. 1-4, the central brace 118 may connect the first front corner 124, the second front corner 126, the first rear corner 132, and the second rear corner 134 to each other. The central brace 118 may include a center portion 146, a first front arm 148, a second front arm 150, a first rear arm 152, and a second rear arm 154. The first front arm 148 may connect the first front corner 124 to the center portion 146. The second front arm 150 may connect the second front corner 126 to the center portion 146. The first rear arm 152 may connect the first rear corner 132 to the center portion 146, and the second rear arm 154 may connect the second rear corner 134 to the center portion 146. As shown in FIGS. 3-4, the first front arm 148 and the second front arm 150 may have a front arm length 156, and the first rear arm 152 and the second rear arm 154 have a rear arm length 158. The front arm length 156 may be greater than the rear arm length 158, an arrangement which accommodates a specific type of chair 102, for example, an Adirondack style chair.

As shown in FIGS. 1 and 3, there may be a plurality of holders 120 disposed at each the first front corner 124, the second front corner 126 the first rear corner 132, and the second rear corner 134. The plurality of holders 120 may each have a base 160, a drainage hole 162 disposed in the base 160, and a plurality of walls 164. The base 160 and the plurality of walls 164 together may define a recess 166 configured to receive one of the plurality of legs 104 of the chair 102. In a most particular embodiment, the recess 166 may decrease in size towards the base 160. With continued reference to FIGS. 1 and 3, the first front corner 124, the second front corner 126, the first rear corner 132, and the second rear corner 134, may each have a corner border 170 that circumscribes one of the plurality of holders 120. As shown in FIGS. 1-2, the corner border 170 may have a corner border side surface 172 and a pair of angled side surfaces 174. Further, the front support 110, the rear support 112, the first side support 114, and the second side support 116, may each have a support side surface 176. Each of the pair of angled side surfaces 174 of the corner border 170 may connect the corner border side surface 172 to the support side surface 176.

As shown in FIGS. 2 and 4, in certain embodiments, there may be a plurality of structural ribs 122 disposed in the bottom side 108 of the shipping tray 100. More specifically, the bottom side 108 of each of the front support 110, the rear support 112, the first side support 114, the second side support 116, and the central brace 118 may be hollow with the plurality of structural ribs 122 disposed within.

With continued reference to FIGS. 2 and 4, in certain embodiments the plurality of structural ribs 122 of the front support 110 may include a first front rib 178, a second front rib 180, and a third front rib 182. The first front rib 178 may be disposed adjacent to the first front corner 124, and the second front rib 180 may be disposed adjacent to the second front corner 126. The third front rib 182 may be disposed between the first front rib 178 and the second front rib 180. The first front rib 178, the second front rib 180, and the third front rib 182 may each orthogonally traverse the front support length 128 of the front support 110.

As shown in FIGS. 2 and 4, the plurality of structural ribs 122 of the rear support 112 may include a first rear rib 184, a second rear rib 186, and a third rear rib 188. The first rear rib 184 may be disposed adjacent to the first rear corner 132, and the second rear rib 186 may be disposed adjacent to the second rear corner 134. The third rear rib 188 may be disposed between the first rear rib 184 and the second rear rib 186. The first rear rib 184, the second rear rib 186, and the third rear rib 188 may each orthogonally traverse the rear support length 136 of the rear support 112.

As shown in FIGS. 2 and 4, the plurality of structural ribs 122 of both the first side support 114 and the second side support 116 may include a first side rib 190, a second side rib 192, a third side rib 194, and a fourth side rib 196. The first side rib 190 may be disposed adjacent to the first front corner 124 and adjacent to the second front corner 126. The second side rib 192 may be disposed adjacent to the first rear corner 132 and the second rear corner 134. The third side rib 194 may be disposed between the first side rib 190 and the second side rib 192. The first side rib 190, the second side rib 192, and the third side rib 194 may orthogonally traverse the side support length 140 of the first side support 114 and the second side support 116. The fourth side rib 196 may be arranged parallel to the side support length 140 of the first side support 114 and the second side support 116. The fourth side rib 196 may extend between the first front corner 124 and the first rear corner 132, and may extend between the second front corner 126 and the second rear corner 134.

With continued reference to FIGS. 2 and 4, the plurality of structural ribs 122 of the central brace 118 may include a first center rib 198, a second center rib 200, a first brace rib 202, a second brace rib 204, a third brace rib 206, and a fourth brace rib 208. The first center rib 198 may be disposed between a first junction 210 formed by the first front arm 148 and the second front arm 150, and a second junction 212 formed by the first rear arm 152 and the second rear arm 154. The second center rib 200 may be disposed between a third junction 214 formed by the first front arm 148 and the first rear arm 152, and a fourth junction 216 formed by the second front arm 150 and the second rear arm 154. As shown in FIG. 2, the first brace rib 202 may traverse the first front arm 148 between the second front corner 126 and the center portion 146 of the central brace 118. The second brace rib 204 may traverse the second front arm 150 between the second front corner 126 and the center portion 146 of the central brace 118. The third brace rib 206 may traverse the first rear arm 152 between the first rear corner 132 and the center portion 146, and the fourth brace rib 208 may traverse the second rear arm 154 between the second rear corner 134 and the center portion 146 of the central brace 118.

As shown in FIGS. 2 and 4, the plurality of structural rib may include a plurality of first corner ribs 218, a plurality of second corner ribs 220, a plurality of third corner ribs 222, and a plurality of fourth corner ribs 224 each disposed in the bottom side 108 of the corner border 170 surrounding each of the plurality of holders 120. The plurality of first corner ribs 218 may be disposed between the first front corner 124 and one of the plurality of holders 120. The plurality of second corner ribs 220 may be disposed between the second front corner 126 and one of the plurality of holders 120. The plurality of third corner ribs 222 may be disposed between the first rear corner 132 and one of the plurality of holders 120. The plurality of fourth corner ribs 224 may be disposed between the second rear corner 134 and one of the plurality of holders 120.

The plurality of structural ribs 122 is purposefully arranged to effect necessary structural support, so the collective weight of a plurality of stacked chairs 103 does not cause the shipping tray 100 to bend or crack. In the embodiments described here, as shown in FIGS. 2 and 4, the arrangement of the plurality of structural ribs 122 is optimized, allowing for even distribution of weight across the shipping tray 100, while minimizing the amount of material required for manufacture. For example, the front support 110, the rear support 112, the first side support 114, and the second side support 116 may only have three of the plurality of structural ribs 122, and yet, due to the spacing and organization of the plurality of structural ribs 122 as a whole, still provide adequate support for the shipping tray 100. It should be noted, however, that one skilled in the art could employ any arrangement or number of the plurality of structural ribs 122 as deemed effective or necessary for the shipping tray 100.

Figure 5:
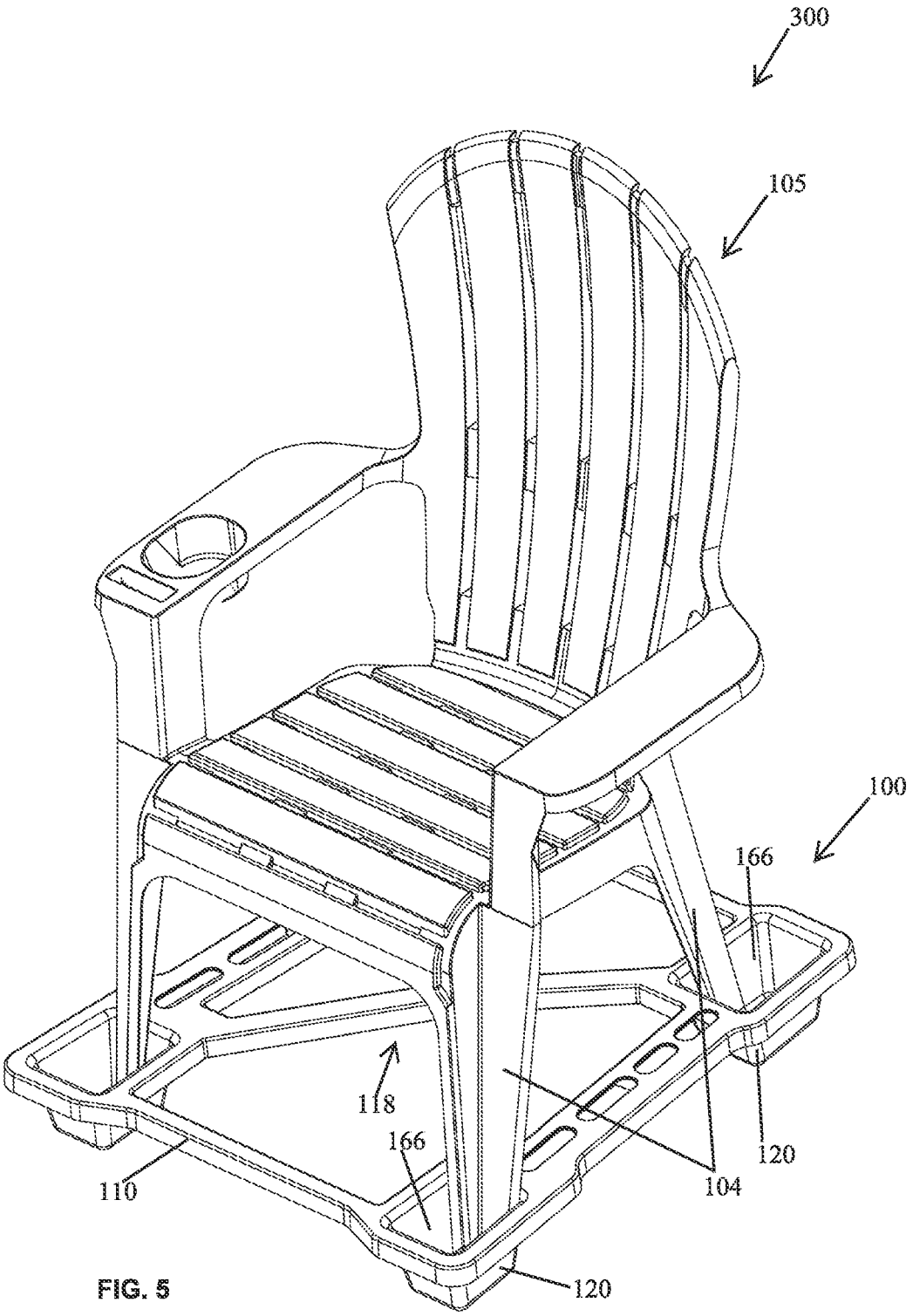
FIG. 5 is a front top perspective view of a chair having a plurality of legs disposed in the shipping tray of the present disclosure.
Figure 6:
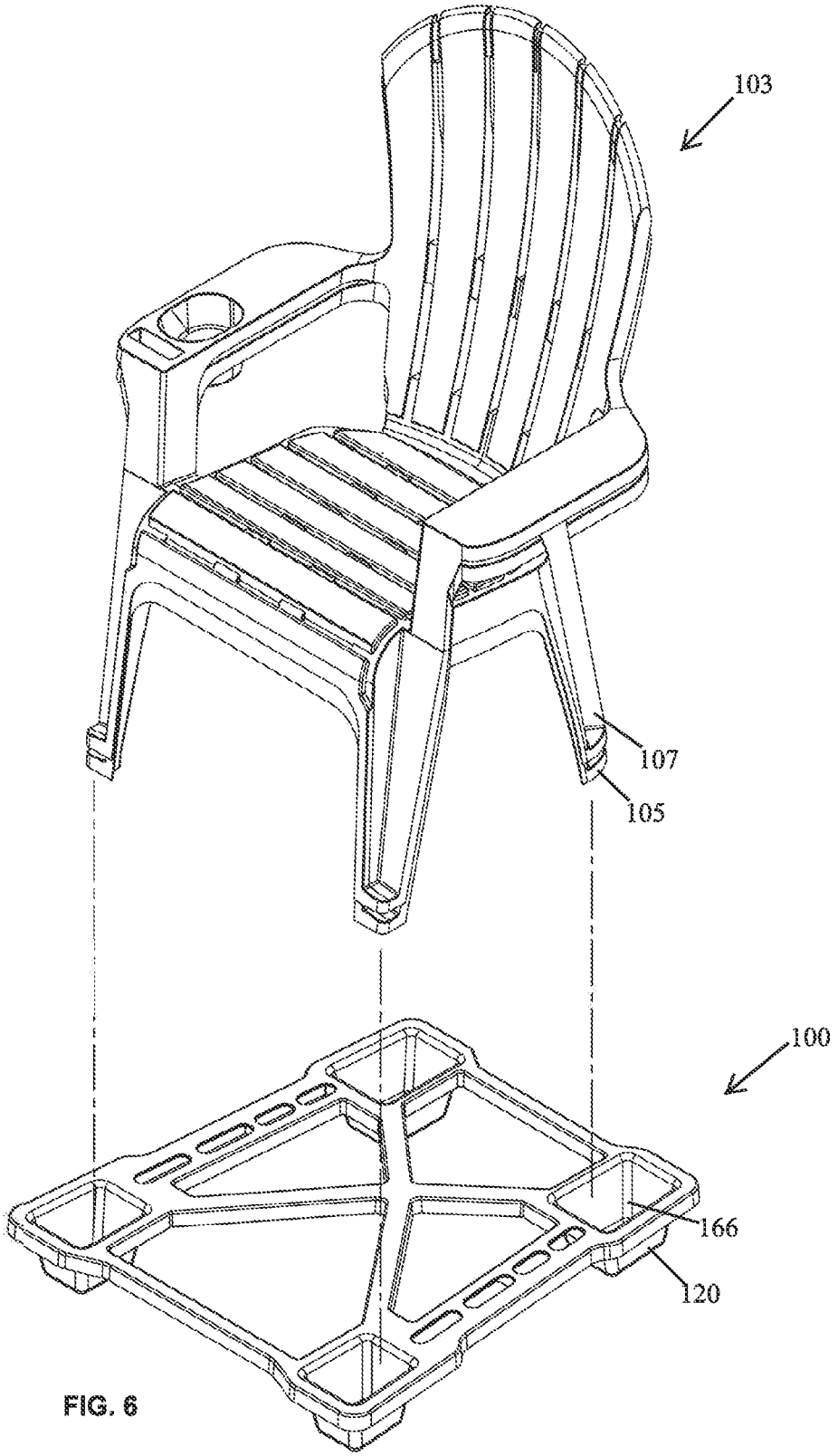
FIG. 6 is a front top perspective view of a plurality of chairs stacked together and a shipping tray, illustrating a method of disposing the plurality of chairs within the shipping tray according to the present disclosure.

FIG. 5-6 shows a shipping tray system 300 comprising a shipping tray 100 for a chair 102 having a plurality of legs 104, and a first chair 105 having a plurality of legs 104. The shipping tray 100 may include a top side 106, a bottom side 108, a front support 110, a rear support 112, a first side support 114, a second side support 116, a central brace 118, a plurality of holders 120, and a plurality of structural ribs 122. The plurality of legs 104 of the first chair 105 may be received in the plurality of holders 120 of the shipping tray 100. Additionally, the first chair 105 may comprise a plurality of stacked chairs 103 that includes multiple of the chairs 102 stacked on top each other and on top of the first chair 105.

Figure 7:
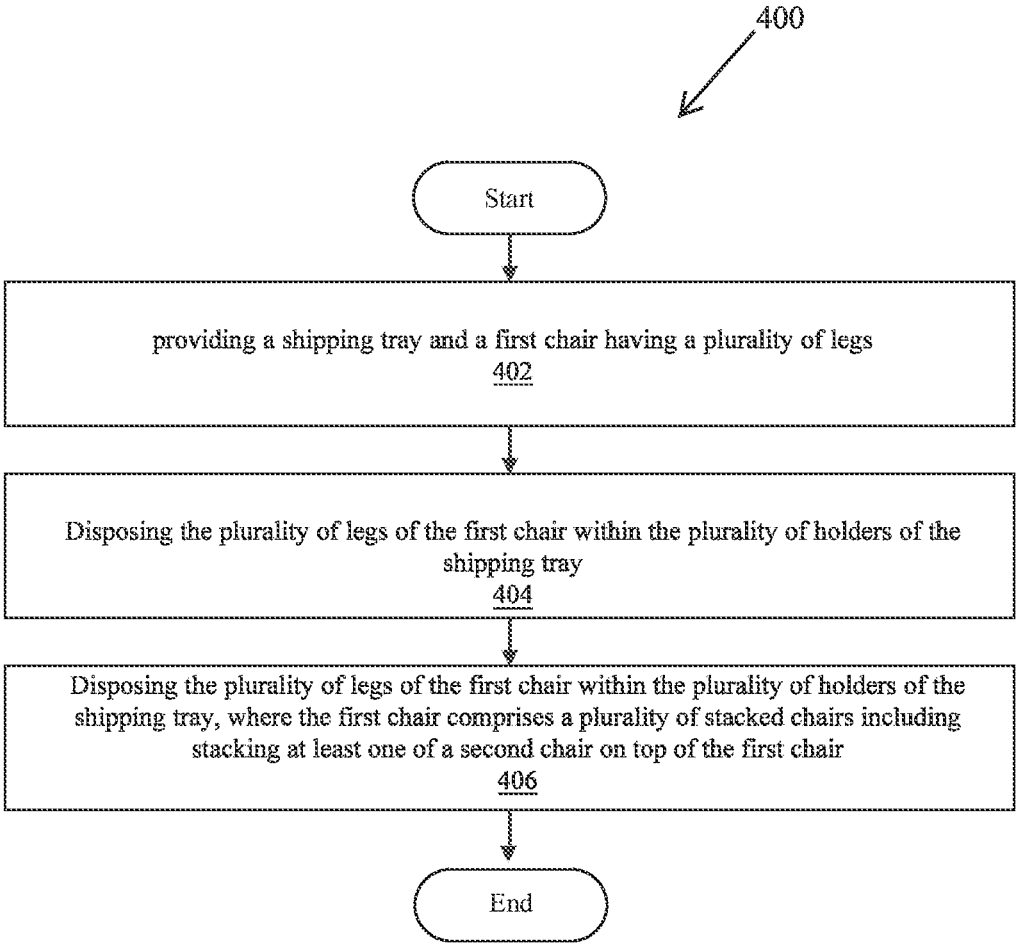
FIG. 7 is a flow chart illustrating the method of stacking a chair having a plurality of legs on a shipping tray of the present disclosure.

FIG. 7 shows a method 400 of stacking a chair 102 having a plurality of legs 104 on a shipping tray 100. The method 400 may include a first step 402 of providing a shipping tray 100 and a first chair 105 having a plurality of legs 104. The shipping tray 100 may have a top side 106, a bottom side 108, a front support 110, a rear support 112, a first side support 114, a second side support 116, a central brace 118, a plurality of holders 120, and a plurality of structural ribs 122. The method 400 may include a second step 404 of disposing the plurality of legs 104 of the first chair 105 within the plurality of holders of the shipping tray 100. Additionally, the second step 404 of the method 400 may be repeated in a third step 406, so that the first chair 105 could comprise a plurality of stacked chairs 103 stacked on top of the first chair 105. The plurality of stacked chairs 103 may include stacking at least one of a second chair 107 on top of the first chair 105.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A shipping tray for a chair having a plurality of legs, comprising:

a top side;

a bottom side;

a front support having a first front corner and a second front corner;

a rear support having a first rear corner and a second rear corner;

a first side support;

a second side support;

a central brace connecting each of the first front corner, the second front corner, the first rear corner, and the second rear corner; and a plurality of holders configured to receive the plurality of legs of the chair, wherein one holder of the plurality of holders is disposed at each of the first front corner, the second front corner, the first rear corner, and the second rear corner;

wherein:

each of the front support, the rear support, the first side support, the second side support, and the central brace is hollow and has a plurality of structural ribs disposed on the bottom side, the plurality of structural ribs of the front support includes a first front rib disposed adjacent the first front corner, a second front rib disposed adjacent the second front corner, and a third front rib disposed between the first front rib and the second front rib, wherein the first front rib, the second front rib, and the third front rib each orthogonally traverse a front length of the front support, the plurality of structural ribs of the rear support includes a first rear rib, a second rear rib, and a third rear rib each orthogonally traversing a rear length of the rear support, the first rear rib disposed adjacent the first rear corner, the second rear rib disposed adjacent the second rear corner, and the third rear rib disposed between the first rear rib and the second rear rib, the plurality of structural ribs of the first side support and second side support each includes a first side rib, a second side rib, a third side rib, each orthogonally traversing a side support length of each the first side support and the second side support, the first rear rib disposed adjacent each the first front corner and second front corner, the second side rib disposed adjacent each the first rear corner and second rear corner, and the third rear rib disposed between the first side rib and the second side rib, the first side support and the second side support each have a fourth side rib oriented parallel with the first side support and the second side support, the fourth side rib being disposed along a side support length between the first front corner and first rear corner, and between the second front corner and the second rear corner, the central brace has a first front arm connecting the first front corner to a center portion, a second front arm connecting the second front corner to the center portion, a first rear arm connecting the first rear corner to the center portion, and a second rear arm connecting the second rear corner to the center portion, a length of each of the first front arm and the second front arm is greater than a length of each of the first rear arm and the second rear arm, and the plurality of structural ribs of the central brace includes a first center rib disposed between a junction formed by the first front arm and second front arm and a junction formed by the first rear arm and the second rear arm and a second center rib disposed between a junction formed by the first front arm and the first rear arm and a junction formed by the second front arm and the second rear arm.

2. The shipping tray of claim 1, wherein the plurality of structural ribs of the central brace includes a first brace rib, a second brace rib, a third brace rib, and a fourth brace rib, each traversing one of the first front arm, the second front arm, the first rear arm, and the second rear arm, the first brace rib disposed between the first front corner and the center portion, the second brace rib disposed between the second front corner and the center portion, the third brace rib disposed between the first rear corner and the center portion, and the fourth brace rib disposed between the second rear corner and the center portion.

3. The shipping tray of claim 2, wherein the plurality of structural ribs includes a plurality of first corner ribs disposed between the first front corner and a first front holder, a plurality of second corner ribs disposed between the second front corner and a second front holder, a plurality of third corner ribs disposed between the first rear corner and a first rear holder, and a plurality of fourth corner ribs disposed between the second rear corner and a second rear holder.

4. The shipping tray of claim 1, wherein a length of the front support is greater than a length of the rear support.

5. The shipping tray of claim 4, wherein a width of the first side support and a width of the second side support are each greater than a width of the front support and a width of the rear support.

6. The shipping tray of claim 5, wherein a plurality of apertures is formed in each of the first side support and the second side support, and each aperture of the plurality of apertures is substantially stadium shaped.

7. The shipping tray of claim 1, wherein each of the first front corner, the second front corner, the first rear corner, and the second rear corner has a corner border that circumscribes the one of the plurality of holders disposed at each of the first front corner, the second front corner, the first rear corner, and the second rear corner.

8. A shipping tray for a chair having a plurality of legs, comprising:

a top side;

a bottom side;

a front support having a first front corner and a second front corner;

a rear support having a first rear corner and a second rear corner;

a first side support;

a second side support;

a central brace connecting each of the first front corner, the second front corner, the first rear corner, and the second rear corner; and a plurality of holders configured to receive the plurality of legs of the chair, wherein one holder of the plurality of holders is disposed at each of the first front corner, the second front corner, the first rear corner, and the second rear corner, wherein:

each of the first front corner, the second front corner, the first rear corner, and the second rear corner has a corner border that circumscribes the one of the plurality of holders disposed at each of the first front corner, the second front corner, the first rear corner, and the second rear corner, each of the front support, the rear support, the first side support, the second side support, and the central brace is hollow and has a plurality of structural ribs disposed on the bottom side, and the corner border has a corner border side surface and a pair of angled side surfaces, and each of the front support, the rear support, the first side support, and the second side support has a support side surface, and each of the pair of angled side surfaces of the corner border connects the corner border side surface and the support side surface.

9. The shipping tray of claim 8, wherein each of the holders includes a base having a drainage hole disposed in the base, and a plurality of walls, the plurality of walls and the base together defining a recess configured to receive one leg of the plurality of legs of the chair, the recess decreasing in size towards the base.

10. A shipping tray system, comprising:

the shipping tray for a chair having a plurality of legs of claim 8; and a first chair having a plurality of legs, the plurality of legs received in the plurality of holders of the shipping tray.

11. The shipping tray system of claim 10, wherein the first chair comprises a plurality of chairs stacked on top of the first chair, the plurality of chairs including at least one of the chair stacked on top of another of the chair.

12. A method of stacking a chair having a plurality of legs on a shipping tray, comprising:

providing a first chair having a plurality of legs;

providing the shipping tray for a chair having a plurality of legs of claim 8;

disposing the first chair having the plurality of legs on the shipping tray so that the plurality of holders of the shipping tray receives the plurality of legs of the first chair.

13. The method of claim 12, wherein the first chair is comprised by a plurality of chairs stacked on top of one another.

* * * * *